United States Patent [19]

Reed

[11] Patent Number: 4,708,201

[45] Date of Patent: Nov. 24, 1987

[54] TOP ENTRY ELECTRICAL TRANSMISSION ASSEMBLY FOR SUBMERSIBLE PUMPING

[76] Inventor: Lehman T. Reed, 3505 Chester Ave., Bakersfield, Calif. 93301

[21] Appl. No.: 666,291

[22] Filed: Oct. 29, 1984

[51] Int. Cl.[4] ..... E21B 33/04; H01R 4/64

[52] U.S. Cl. ..... 166/65.1; 166/97.5; 439/191

[58] Field of Search ..... 166/65 R, 75 A, 85, 166/75 R; 339/15, 16 RC, 16 C, 16 R, 60 C, 117 R, 5 R, 5 M, 6 R, 8 R

[56] References Cited

U.S. PATENT DOCUMENTS

| | | | |
|---|---|---|---|
| 3,437,149 | 4/1969 | Cugini et al. | 166/88 |
| 3,739,073 | 6/1973 | Schneider et al. | 166/65 R |
| 4,154,302 | 5/1979 | Cugini | 166/65 R |
| 4,289,199 | 9/1981 | McGee | 166/65 R |
| 4,491,176 | 1/1985 | Reed | 166/85 |

*Primary Examiner*—Stephen J. Novosad
*Assistant Examiner*—Bruce M. Kisliuk

[57] ABSTRACT

A pivotally adjustable, low profile, top entry, electrical transmission assembly for removably effecting electrical communication through a tubing hanger between an above ground electric power supply cable and an electric power receiving cable that extends upwardly from a submersible unit in a bore hole. The assembly may be removed from the tubing hanger for maintenance without removing the tubing hanger from the wellhead in which it is disposed. The portion of the assembly above the wellhead is of angled structure to minimize the height thereof which is of importance on oil islands where wells are closely spaced and drilling and maintenance equipment must be periodically moved over the wells. The assembly due to being pivotally adjustable permits the power supply cable associated therewith to extend from the wellhead in a desired direction.

4 Claims, 10 Drawing Figures

TOP ENTRY ELECTRICAL TRANSMISSION ASSEMBLY FOR SUBMERSIBLE PUMPING

BACKGROUND OF THE INVENTION

In the past, electrical power receiving cables from downhole pumps and the like have been extended upwardly through bores in tubing hangers or through cable feed throughs in the tubing hanger to a source of electric power. Such installations have the operational disadvantage that when it is necessary to perform maintenance work on the power supply cables beneath the tubing hangers, the latter must be lifted upwardly from the wellhead in which they are disposed. Lifting of a tubing hanger together with the tubing string supported therefrom can only be accomplished by use of an expensive power operated mobile unit. Lifting of the tubing hanger even in relatively shallow wells can cost thousands of dollars.

An example of a wellhead feed through of the above described pipe that has been used extensively is disclosed in U.S. Pat. No. 3,437,149 entitled "CABLE FEED THROUGH MEANS AND METHOD FOR WELLHEAD CONSTRUCTION", which patent issued Apr. 8, 1969 to Edward T. Cuginino. This device had the operational disadvantages previously mentioned.

A major object of the present invention is to provide a low profile, top entry assembly for mounting on a tubing hanger to supply electric power to a submersible unit, such as a downhole pump, and with the portion of the assembly in the tubing hanger being removable therefrom without lifting the tubing hanger from the wellhead in which it is mounted.

Another object of the invention is to provide an electrical transmission assembly that extends upwardly a minimum distance above the tubing hanger, which is of importance on oil islands for wells that are closely spaced, as is periodically necessary to move drilling and maintenance equipment over the wells.

A further object of the invention is to provide an assembly that when mounted on a tubing hanger is pivotally adjustable thereto, to permit the electrical supply cable to extend from the tubing hanger in a desired direction.

Yet another object of the invention is to provide an assembly in which the electrical contacts situated within the interior of the tubing hanger are fully protected from moisture and corrosive action of gases that may be present in the well bore with which the tubing hanger is associated.

These and other objects and advantages of the invention will be apparent from the following details description thereof.

REFERENCE TO RELATED APPLICATIONS

U.S. patent application Ser. No. 432,300, entitled: ELECTRIC POWER SUPPLYING WELL HEAD ASSEMBLY, filed Oct. 1, 1982, now U.S. Pat. No. 4,491,176.

SUMMARY OF THE INVENTION

The low profile, top entry, electrical transmission assembly of the present invention is used in combination with a wellhead situated above a bore hole containing an electrically operated unit, from which unit a cable containing a number of electric power receiving conductors extends upwardly to terminate in the free end.

A bonnet is mounted on the wellhead, with the bonnet having a first fluid flow conducting bore therein. The bonnet and wellhead are separated by a gasket disposed therebetween, and the wellhead and bonnet being removably connected by conventional means. The wellhead supports a tubing hanger that has a first vertical bore therein that is axially aligned with a second vertical bore in the bonnet. An above ground electric supply cable that has a number of power transmitting conductors therein is provided and extends to the wellhead.

The top entry electrical transmission assembly includes a number of first laterally spaced vertically extending electrical conducting engageable members that are held in spaced relationship and in electrical communication with the electrical conductors in the power receiving cable by a lower connector that extends into the lower portion of the first bore and is secured to the lower surface of the tubing hanger.

A number of laterally spaced, vertically extending upper and lower electrical conducting engaging members that are longitudinally spaced and in electrical communication with one another are so held by an elongate body of a dielectric material that cooperates with the engaging members to provide an electrical transmission element that is slidably and removably mounted in the first bore of the tubing hanger and extending into the second bore of the bonnet.

When the electrical transmission element is so disposed, the lower engaging members are in slidable and removable engagement with the first engageable electrical conducting members. A number of second laterally spaced, vertically extending, electrical conducting engageable members are provided that are held in fixed relationship with one another by an upper connector that so supports them and in electrical communication with the electrical conductors in the electric power supply cable.

The upper connector has a first portion that extends downwardly in the second bore for the second engageable members to engage the upper engaging members. Indexing means are provided for moving the first portion of the upper connector downwardly to the extent that the upper engaging members are in full engagement with the second engageable members.

The upper connector has a second portion that is angularly disposed relative to the first portion and connected to the electrical power supply cable, and due to this construction the height of the invention above the wellhead is minimized. The upper connector is pivotally supported on the bonnet, and as a result the invention may be rotated relative to the latter to have the power supply cable extend from the wellhead in a desired direction. The upper and lower connectors, as well as the electrical transmission element have sealing means operatively associated therewith to prevent the entry of corrosive gases from the bore hole as well as moisture into the interior of the invention to corrode the engaging and engageable members.

When it is desired to perform maintenance work on the invention, the upper connector is removed from the bonnet, with the bonnet subsequently being removed from the wellhead. The electrical transmission element may then be removed from the tubing hanger, without the tubing hanger being removed from the wellhead. Maintenance work may now be performed on both the upper connector and the electrical transmission element, after the maintenance work has been performed, the assembly in return to an operating position by reversing the steps above described.

DESCRIPTION OF THE PREFERRED EMBODIMENTS

Figure 1:
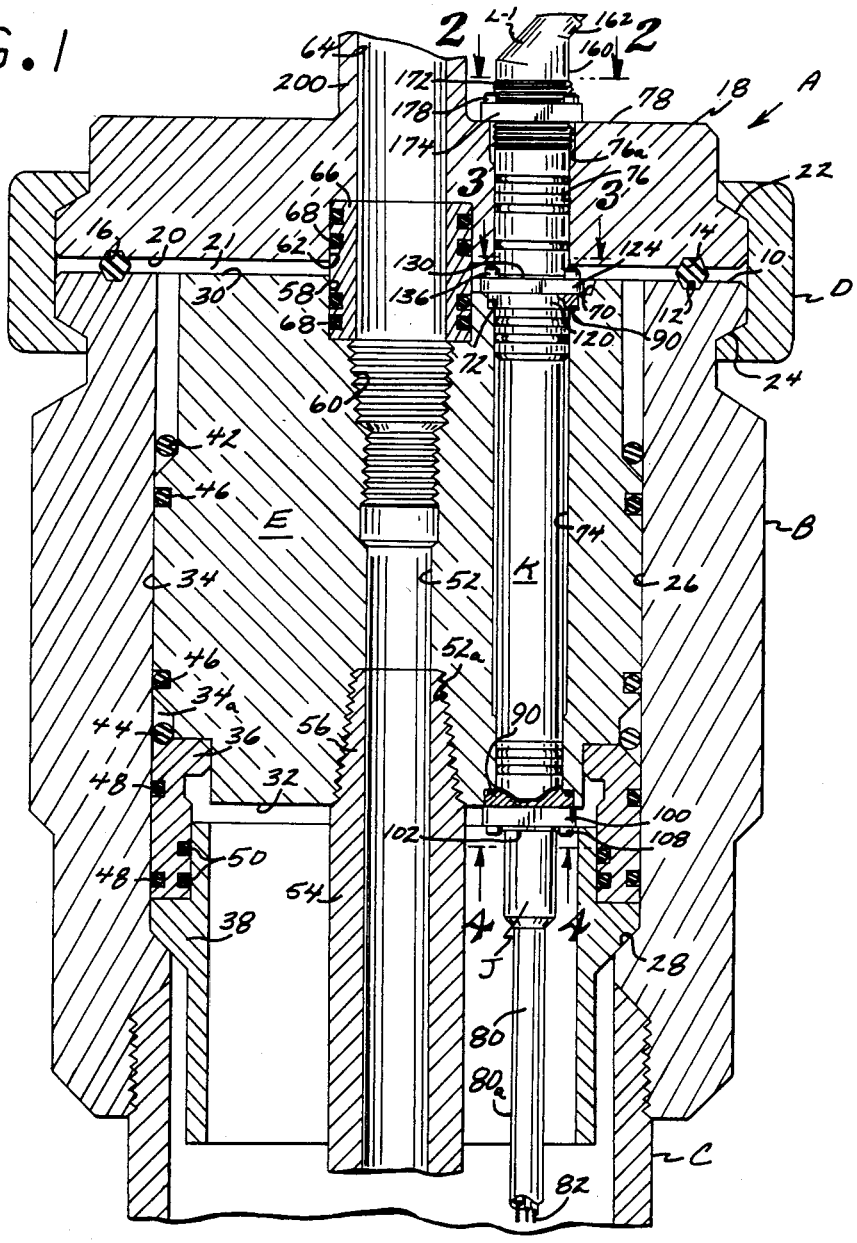
FIG. 1 is a longitudinal cross sectional view of the top entry, electrical transmission assembly for use on a wellhead that is operatively associated with a submersible electrically operated unit such as a pump.
Figure 2:
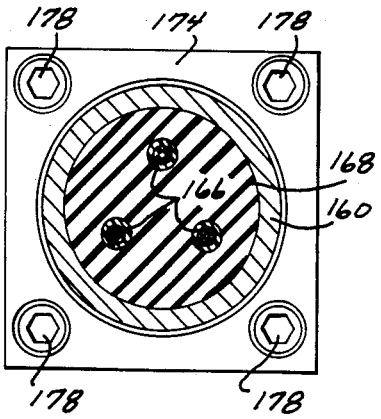
FIGS. 2, 3 and 4 are fragmentary transverse cross sectional views of the invention taken on the lines 2—2, 3—3 and 4—4 of FIG. 1.
Figure 3:
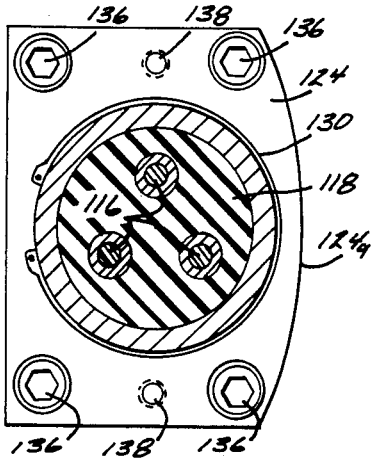
Figure 4:
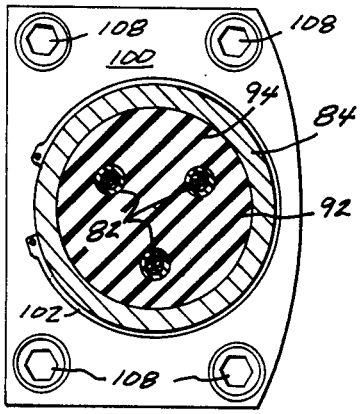

The top entry electrical transmission assembly A for submersible pumps is mounted on a conventional wellhead B of generally cylindrical shape that is threadedly secured to the upper end of a surface casing string C as may be seen in FIG. 1. The wellhead has a flat top surface 10 from which a cylindrical groove 12 extends downwardly and is removably engaged by a gasket 14. A circular groove 16 also engages the gasket 14 and is defined in the lower surface 20 of a sealing flange 18, or bonnet as it is referred to in the oil fields. The gasket 14 is of sufficient transverse cross section to maintain a space 21 between the bonnet 18 and top surface 10 of the wellhead B.

The bonnet 18 and the wellhead B adjacent thereto define tapered circular surfaces 22 and 24 as shown in FIG. 1 that are engaged by a clamp D of conventional design to removably maintain the bonnet on the wellhead. The wellhead B has a cylindrical interior surface 26 that on the lower end develops into a tapered body shoulder 28 as shown in FIG. 1. The wellhead B as may be seen in FIG. 1 movably supports a generally cylindrical tubing hanger E that has a flat top surface 30, lower flat surface 32, and a cylindrical side surface 34 that is of slightly less diameter than the cylindrical side surface 26. Tubing hanger E includes a lower circumferentially extending recessed portion 34*a* in which an upper portion of a sealing ring 36 is disposed to support the tubing hanger E at a fixed elevation within the casing head B. The sealing ring 36 as shown in FIG. 1 rests on a support ring 38, that is mounted on the downwardly tapered body shoulder 28 of the casing head B.

Upper, lower, and intermediate sealing rings 42, 44 and 46 are mounted on the exterior surface of the tubing hanger E to seal with the interior cylindrical surface of the casing head B, and with the lower sealing ring also sealing with the sealing ring 36. Exterior and interior pairs of sealing rings 48 and 50 are mounted on the sealing ring 36 to removably seal with the interior surface 26 of the casing head B as well and the exterior surface of the support ring 38 as illustrated in FIG. 1

The tubing hanger A has a centered, vertically extending, well fluid conducting bore 52 therein, which bore has a lower threaded portion 52*a* that engages the threaded upper end 56 of a tubing string 54 that extends downwardly to the submersible electrically operated unit (not shown). A recess 58 extends downwardly in the tubing hanger E from the flat top surface 30 to develop into a threaded portion 60 of the bore 52. The threaded portion 60 may be engaged by a threaded mandrel (not shown) to lift the tubing hanger E from the wellhead B when the bonnet 18 is removed from the wellhead.

The bonnet 18 has a centered upwardly extending recess 62 therein that communicates with a bore 64 that is defined in a tubular member that extends upwardly from the bonnet and through which well fluid may flow. The two recesses 58 and 62 are axially aligned and are removably engaged by a well fluid conducting sleeve 66 that has a number of vertically spaced resilient sealing rings 68 mounted thereon that are in sealing contact with the portions of the wellhead B and bonnet 18 that define the cavities 58 and 62. The bore 52 and the sleeve 66 cooperate to removably maintain communication with the bore 64 into which fluid from the submersible pumping unit (not shown) is discharged as the well is operated.

In FIG. 1 it will be seen that a recess 70 extends down from the upper surface 30 of the tubing hanger E and develops into a cavity 72 of circular transverse cross section from which a first bore 74 extends downwardly through the tubing hanger to the lower surface 32 thereof. A second bore 76 is axially aligned with the first bore 74 and is formed in the bonnet 80. The second bore 76 extends upwardly from the lower surface 20 of the bonnet 18 to develop into an enlarged upper end portion 76*a* adjacent the top surface 78 of bonnet 18.

Figures 9, 10:
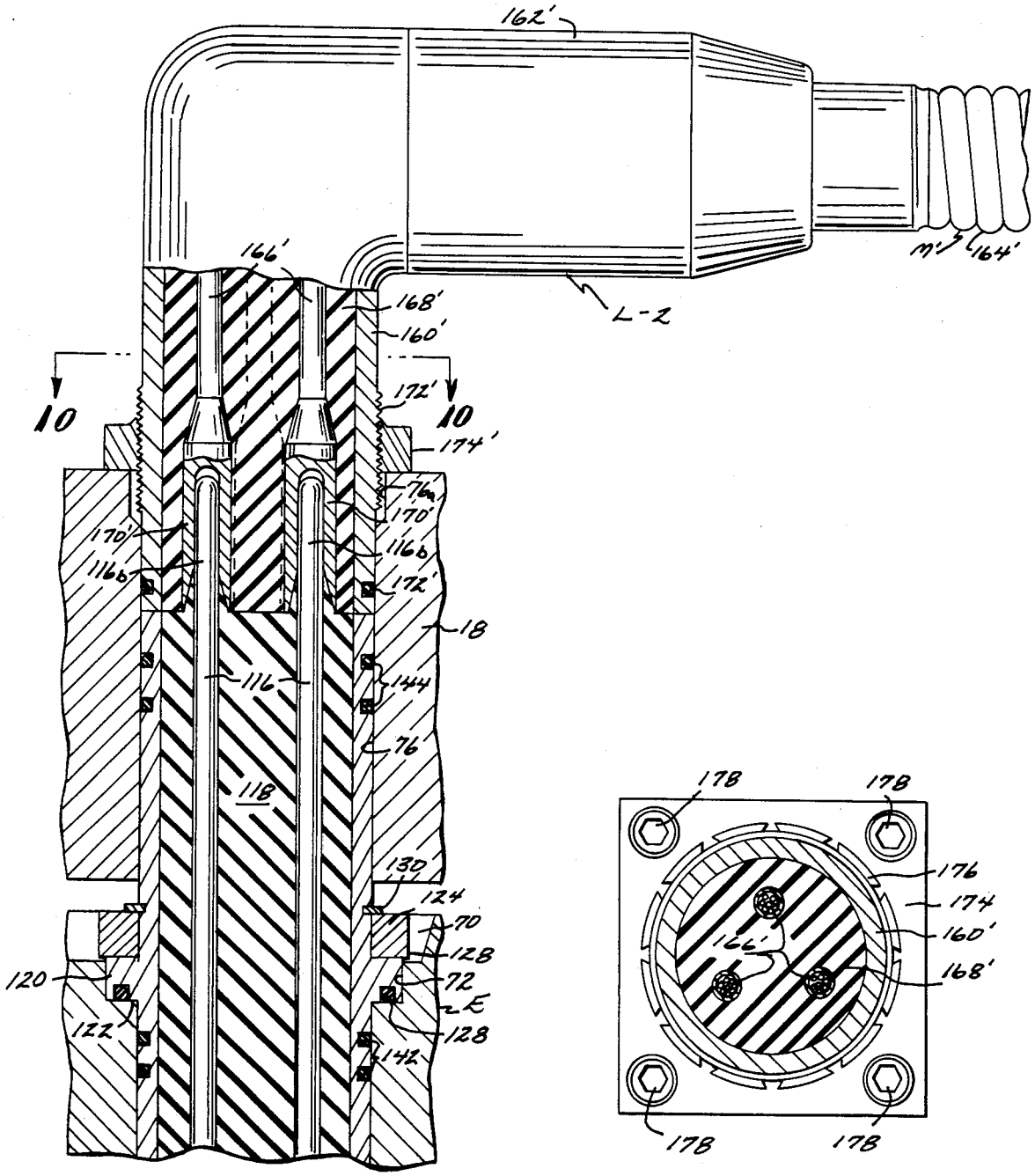
FIG. 9 is an enlarged longitudinal, fragmentary, cross sectional view of a second form of upper electrical connectors.
FIG. 10 is a transverse cross sectional view of the second form of connector taken on the line 10—10 of FIG. 9.

The electrical transmission assembly A includes a lower connector J best seen in FIG. 1 that is secured to the lower surface 32 of the tubing hanger and is connected to an electric power receiving cable 80 that extends down to an electrically operated submersible unit (not shown) located in the bore (not shown) below the wellhead B. The cable 80 has an outer sheath 80*a* that has a number of electrical conductors 82 situated within the confines thereof and electrically insulated from one another. The lower connector J may be removably engaged by an elongate electrical transmission element K as shown in FIG. 1 that is situated in the first bore 74 and extends upwardly into the second bore 76. An electric power supply cable M may have either a first form of upper connector L-1 secured thereto as shown in FIG. 5 or a second form of connector L-2 as illustrated in FIG. 9, with either of these forms of upper connector capable of being removably mounted in the second bore 76 to supply electric power to the electrical transmission element K and to the cable 80.

Figure 5:
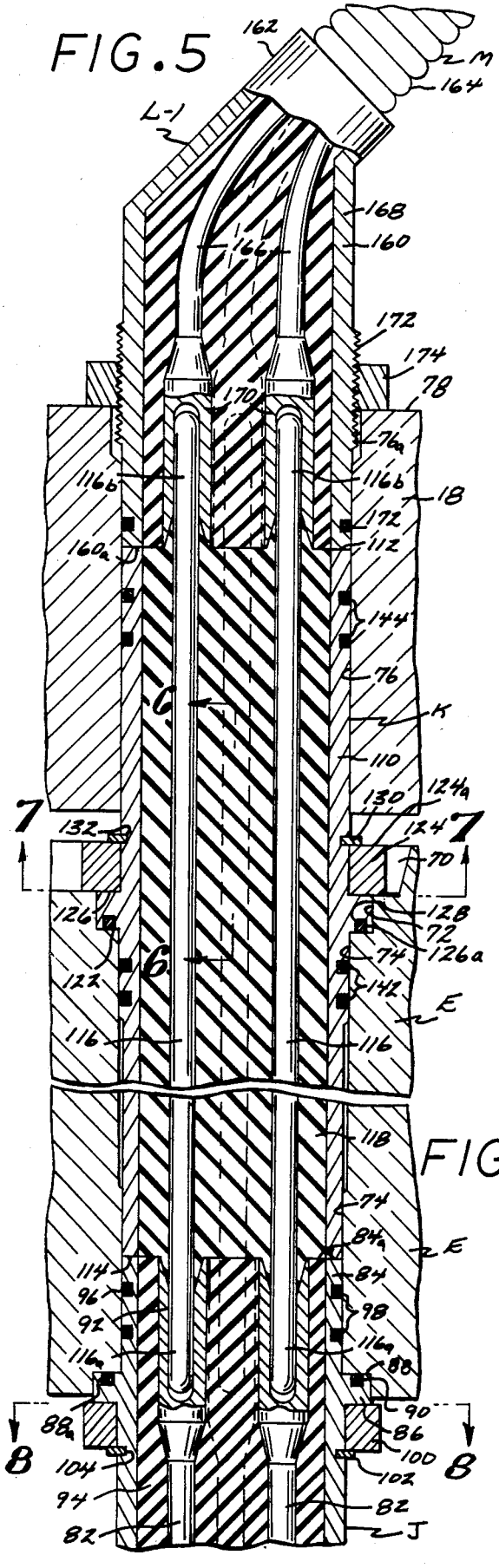
FIG. 5 is an enlarged fragmentary longitudinal cross sectional view of the invention illustrating a first form of upper connector.

The lower connector J as can best be seen in FIG. 5 includes a rigid cylindrical shell 84 of such external diameter that it may be snuggly and slidably inserted within the lower end portion of the first bore 74. The shell 84 has an upper end surface 84*a*. A circular rib 86 extends outwardly from the shell 84 a substantial distance below the upper end surface 84*a*. The rib 86 has an upper surface 88 in which a groove 88*a* is defined that is engaged by a resilient sealing ring 90. Each of the conductors 82 as shown in FIG. 5 is connected to an elongate metallic socket 92 that extends upwardly to the upper surface 84*a* of the shell 84.

The sockets 92 and the conductors 82 are held in spaced relationship within the lower connector J by a solid dielectric material 94 as shown in FIG. 5. The portion of the shell 84 within the first bore 74 has two vertically spaced, circumferentially extending, grooves 96 formed therein in which sealing rings 98 are disposed that pressure contact the lower portion of the first bore 74 to prevent moisture or corrosive gases from the bore hole (not shown) entering the first bore 74, and the sealing ring 90 also serving to prevent such upward flow of moisture or corrosive gases into the first bore 74.

Figure 8:
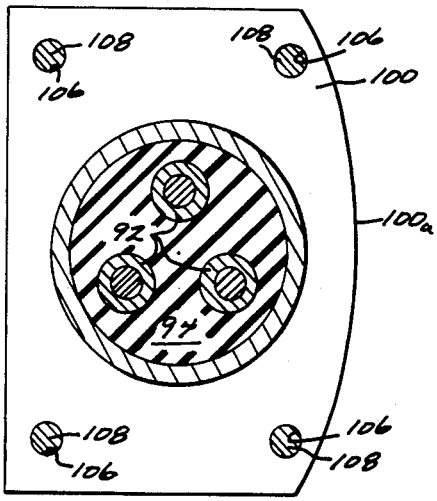

A loose flange 100 is mounted on the exterior of the cylindrical shell 84 and is held in slidable abutting contact with the tub 86 by a snap ring 102 best seen in FIG. 5 that engages a circumferentially extending groove 104 defined on the outer surface of the cylindrical shell. The flange 100 has a number of spaced bores 106 formed therein as shown in FIG. 8 through which bolts 108 extend upwardly to engage tapped recesses (not shown) in the tubing hanger E to support the plate 100 from the lower surface 32 of the tubing hanger. One edge surface 100*a* of the flange 100 is of convex arcuate shape as shown in FIG. 8. As the bolts 108 shown in FIG. 1 are tightened the flange 100 is moved upwardly to force the rib 86 and sealing ring 90 into a cavity that extends upwardly from the end surface 32. Rib 86 and shell 84 are rotatably movable relative to flange 100.

The electrical transmission element K as may best be seen in FIG. 5 includes an elongate cylindrical shell 110 of rigid material that has an upper end 112 and lower end 114. The external transverse cross section of the cylindrical shell 110 is such that it may be slidably and snuggly inserted within the first bore 74 as well as the second bore 76 as shown in FIG. 5. A number of elongate electrical conductors 116 of greater length than the shell 110 extend longitudinally therethrough and are held in the same transverse spacing within the shell as the spacing of the sockets 92, by a dielectric material 118.

The portion of the electrical conductors 116 that extend downwardly below the body of dielectric material 118 define lower prongs 116*a* and the portions that extend upwardly above the body of the dielectric material provide upper prongs 116*b*. A circular rib 128 extends outwardly from the shell 110 as may be seen in FIG. 5, and is so located longitudinally thereon that when the rib is in abutting contact with body shoulder 122 the lower prongs 116*a* are in substantially full engagement with the sockets 92 as illustrated in FIG. 5. The body shoulder 122 is defined at the junction of the cavity 72 with the first bore 74 as shown in FIG. 5. A second flange 124 is provided as shown in FIG. 5 that is loosely mounted on the shell 110. A snap ring 130 encircles the shell 110 and engages a groove 132 on the exterior surface thereof, which groove is so located that when the snap ring is disposed therein the second flange is held in abutting contact with the rib 128. The rib 128 supports a sealing ring 126*a* on the lower surface thereof that seals with the body shoulder 122 as shown in FIG. 5. The thickness of the flange 124 is so related to the depth of recess 70 that the upper surface 124*a* of the flange and the upper surface 30 of the tubing hanger 80 are substantially flush as shown in FIG. 5.

Figure 6:
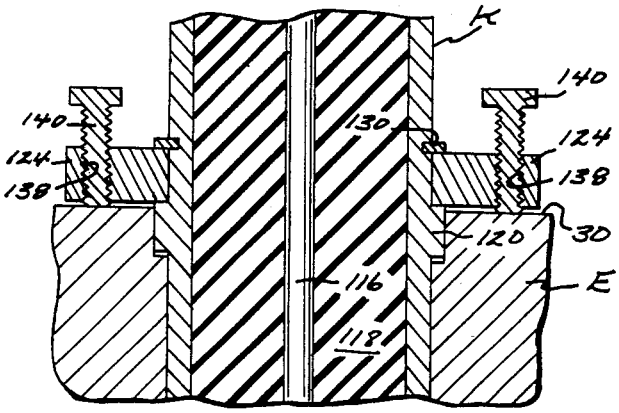
FIG. 6 is a fragmentary longitudinal cross sectional view of the invention taken on the line 6—6 of FIG. 5.
Figure 7:
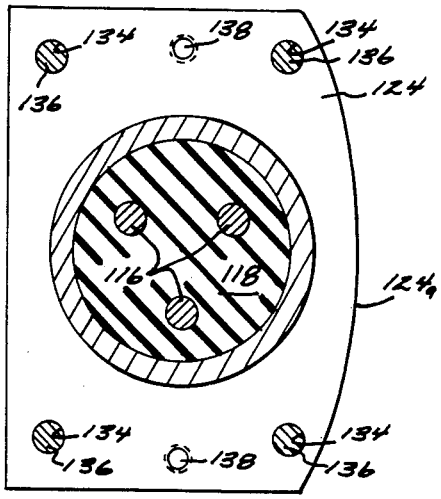
FIGS. 7 and 8 are transverse cross sectional views of the invention taken on the lines 7—7, and 8—8 of FIG. 5.

The second flange 124 as shown in FIG. 7 has a number of spaced transverse bores 134 therein through which cap screws 136 extend to engage tapped recesses (not shown) that extend downwardly from the upper surface 30 into the tubing hanger E. The second flange 124 as shown in FIG. 6 has a pair of oppositely spaced tapped bores 138 extending transversely therethrough that may be engaged by a pair of bolts 140 when the bonnet 18 is removed from the wellhead B, which bolts when rotated in an appropriate direction have the lower ends thereof bear against the upper surface 30 of the tubing hanger E, with the result that the electrical transmission element K is moved upwardly from the first bore 74. The second flange 124 has an arcuate convex edge surface 124*a* as shown in FIG. 7 to permit it to be disposed in recess 70. The shell 110 has a pair of grooves below the ring 120 in which sealing rings 142 are disposed that pressure contact the bore 74. Second sealing rings 144 are mounted on the shell 110 in the same manner above second flange 124 to pressure contact the second bore 76. The heads of the bolts 136 as may be seen in FIG. 1 are situated in the space 21 between the upper surface 30 of the tubing hanger E and the lower surface 20 of the bonnet 18.

The first form of upper connector L-1 as best seen in FIG. 5 includes a cylindrical shell 160 that has a lower end surface 160*a* and is of such external diameter as to snuggly and slidably engage the second bore 76. The shell 160 includes an upper extension 162 of smaller transverse cross section and that is angularly disposed to the former, to provide the upper connector L-1 that has a low profile above the upper surface of the bonnet 18. The extension 162 is connected to the sheath 164 of the cable M. A number of electrical conductors 166 extend through the cable M and into a body of dielectric material 168 situated within the shell 160, which material tends to hold the conductors 166 in spaced relationship. Each conductor 166 on the downwardly extending end thereof is connected to an electrical conducting second socket 170, and the material 168 holding the sockets 170 in the same laterally spaced relationship as the prongs 116*b*.

The shell 168 adjacent the lower end 160*a* thereof has a groove extending circumferentially therearound in which a sealing ring 172 is disposed that pressure contacts the material of bonnet 18 that defines the bore 76 as shown in FIG. 5. The second bore 76 in the bonnet 18 has an enlarged upper end portion 76*a* as may be seen in FIG. 5. The shell 160 has threads 172 defined on the external surface thereof, which threads extend downwardly into the enlarged portion 76*a* when the upper electrical conducting sockets 170 are in engagement with the upper prongs 116*b*. An internally threaded square flange 174 is provided that engages the threads 172 and serves the dual function of holding the first form of connector L-1 in a fixed position on the bonnet 18, as well as indexing the depth that the upper sockets 172 will make relative to the upper prongs 116*b* that they removably engage. The flange 174 has four equally spaced bores (not shown) extending downwardly therethrough that are engaged by cap screws 178 that engage downwardly extending tapped bores (not shown) in the bonnet 18.

In positioning the upper connector L-1 for power transmission purposes to the cable 80, the distance from the top surface 112 of cylindrical shell 110 to the upper surface 78 of the bonnet 18 is determined. The distance the prongs 116*b* extend upwardly from the electrical transmission K will be slightly less than this distance. The flange 174 is now adjusted manually on the threads 172 on shell 60 so that the portion of the shell below the flange is of a length slightly less than the above mentioned distance. Accordingly, when the flange 174 is in abutting contact with the upper surface 78 of the bonnet 18, the sockets 170 will be in substantially full engagement with the prongs 116*b*. Such adjustment is necessary as bonnets 18 are not precision made, but will vary in thickness. After such adjustment is made cap screws 178 will be mounted in the bores (not shown) in the flange 174 to engage the tapped recesses (not shown) in the bonnet 18 to removably hold the upper connector L-1 in a fixed position on the bonnet. It will be noted in FIG. 5 that the portion of the connector L-1 above the bonnet 18 has a low profile, due to the portion 162 being angularly disposed relative to the cylindrical shell 160.

When the upper and lower sockets 92 and 170 are in engagement with the prongs 116*a* and 116*b*, the lower connector J, the electrical transmission K and the upper connector L-1 may be rotated relative to the tubing hanger E and bonnet 18 to dispose the cable N to extend from the wellhead B in a desired direction. Of course such rotation must take place when the flange 174 is not in locked engagement with the bonnet 18 by cap screws 178. It has been found desirable to have the pitch of the threads 160 such that for every rotation of the flange 174 on the threads the sockets 170 may be raised or lowered 0.050 inches relative to the upper prongs 116*b*, or the vertical movement being substantially 0.012 inches for each 90° revolution of the flange 174.

The second form L-2 of the upper connector is similar to the first form L-1 and differs only in that the portion thereof connected to the cable M is at right angle to the portion that extends downwardly into the second bore 76, with the second form having a lower profile relative to the well head B than the first form. Elements of the second form L-2 of the upper connector are identified by the same numerals used with the first form L-1 but with primes added thereto.

The use and operation of the invention is extremely simple. The bonnet 18 is removed from wellhead B and electrical conducting element K is slidably inserted in first bore 76 for lower prongs 116*a* to engage lower sockets 92. The prongs 116*a* and sockets 92 are in substantially full engagement when ring 120 is in abutting contact with body shoulder 122 as shown in FIG. 5.

The bonnet 18 is now returned to the position shown in FIG. 1, with the upper portion of the electrical transmission element K being slid into the second bore 76. The distance from the top surface 112 of shell 110 to top surface 78 of bonnet 18 is now determined, and the flange 174 so manually adjusted on threads 172 as previously described so that when shell 160 is slidably inserted in first bore 76 the upper prongs 116*b* and sockets 170 are in substantially full engagement when flange 174 abuts against surface 78 as shown in FIG. 1. Cap screws 178 hold both the first and second forms L-1 and L-2 of the upper connector in a fixed position on the bonnet 18. Prior to the cap screws 178 being so used the power supply cable M is disposed in a desired direction relative to the wellhead B. The flange 174 may be manually rotated to obtain fine adjustment of the upper sockets 170 relative to the upper prongs 116*b*. When the invention A is disposed as shown in FIG. 5 it will be seen that the sealing rings 90, 142, 144 and 172 all cooperate to prevent moisture from the ambient atmosphere and gases from the bore hole to enter the invention and corrode the upper and lower metallic sockets 170, 92 and upper and lower metallic prongs 116*b* and 116*a*. Corrosion of the prongs and sockets is highly undesirable as the corroded surface is a poor electrical conductors, and substantial amount of electric power will be lost between the power supply cable M and the power receiving cable 80.

The upper and lower prongs 116*b* and 116*a* are of sufficient strength that when in engagement with upper and lower sockets 170 and 92, the lower connector J, element K and upper connector L-1 or L-2 as the case may be may be pivoted as a unit relative to tubing hanger E and bonnet 18 to dispose electric power supply cable M in a desired direction relative to wellhead B. Such pivotal movement will be limited to substantially 270° if the bonnet 18 has a centered tubular member 200 extending upwardly therefrom.

When it is desired to replace or repair the connection between the electric power supply cable M and the power receiving cable 80, the upper connector L-1 or L-2 as the case may be is removed from the bonnet 18. The bonnet 18 is now removed from wellhead B. Cap screws 140 shown in FIG. 6 are now caused to engage tapped bores 138. The cap screws 140 are now rotated for the lower ends to pressure contact the upper surface 30 of tubing hanger E, with the electrical transmitting element K being moved upwardly to the extent that it may be disengaged from the tubing hanger. The element K may now be repaired or replaced without removing the tubing hanger E from wellhead B. The invention A is returned to an electrical conducting condition by reversing the above described steps.

The invention has been described previously in detail, as has the operation thereof, and need not be repeated.

What is claimed is:

1. In a well apparatus including a casing head having an upper end, a tubing hanger supported in said casing head, said tubing hanger having a top and bottom surface and a first longitudinal bore extending therebetween, a bonnet mounted on said upper end, said bonnet having a top surface from which a second longitudinal bore extends downwardly, said first and second longitudinal bores co-axially aligned, clamp means for removably securing said bonnet to said casing head, a moisture proof electric power transmission assembly for supplying electric power from a source exterior of said well head to an electric power receiving source below said tubing hanger, said moisture proof power transmission assembly including:

a. a lower electric power receiving connector assembly disposed below said tubing hanger and extending upwardly in said first bore, said lower connector assembly including a plurality of first, spaced, vertically extending engageable electrical conducting members and first resilient sealing means;

b. first means for rotatably supporting said lower electrical power receiving connector from said tubing hanger, with said first resilient sealing means in pressure contact with said tubing hanger to prevent moisture entering said first bore;

c. an elongate, generally cylindrical electrical transmission element disposed in both said first and second bores, said element including a plurality of spaced electrical conducting members that have upper and lower engaging end portions, said lower engaging end portions in removable engagement with said first engageable electrical conducting members, and said element including second resilient sealing means which when in pressure contact with said tubing hanger prevent moisture entering the uppermost end of said first bore;

d. an upper electrical connector assembly that has an upper portion and a lower cylindrical portion that are angularly disposed relative to one another, said lower portion rotatably disposed in said second bore said upper connector including a plurality of spaced electrical conductors that have second engageable members that are disposed in said lower portion, said second engageable members in removable engagement with said upper end portions; and e. third sealing means to prevent the entry of moisture into the part of said second bore in which said second engageable member and upper engaging end portion are disposed, with said upper and lower connector assemblies and said electrical transmission element capable of being rotated as a unit relative to said well head apparatus to have said upper portion of said upper connector extend in a desired direction relative to said well head.

2. A moisture proof electrical transmission assembly as defined in claim 1 in which said first means comprises;

f. a flange in a fixed longitudinal position on said lower electric power receiving connector that rotatably supports the latter, said flange having a plurality of spaced bores therein; and, g. a plurality of bolts that extend upwardly through said bores to engage a plurality of tapped recesses that extend upwardly in said tubing hanger from said bottom surface thereof.

3. A moisture proof electrical power transmission assembly as defined in claim 1 in which said first bore at the upper end thereof includes a circular body shoulder and said electrical transmission element includes a circular rib that extends outwardly therefrom and is disposed above said body shoulder, and said second resilient sealing means comprising:

f. a resilient sealing ring disposed above said body shoulder and circular rib;

g. a flanger at a fixed longitudinal position on said electrical transmission element and in abutting contact with said circular rib, said electrical transmission element rotatable relative to said flange, said flange having a plurality of spaced bores therein, and h. a plurality of bolts that extend downwardly through said bores to engage tapped recesses in said tubing hanger, said bolts when tightened moving said flange and circular rib downwardly to force said resilient ring into pressure contact with said body shoulder.

4. A moisture proof electrical transmission assembly as defined in claim 1 which in addition includes:

h. manually adjustable means on said lower portion of said upper electrical connnector that contact said top surface of said bonnet when said plurality of second engageable members are in substantially full surface engagement with said upper engaging end portions.

* * * * *